US006540519B2

(12) United States Patent
Wexler

(10) Patent No.: US 6,540,519 B2
(45) Date of Patent: Apr. 1, 2003

(54) METHOD AND APPARATUS FOR TRACKING AND PROMPTING THE RECITATION OF THE ROSARY

(76) Inventor: Toby Wexler, 303 Paddington Dr., Lafayette, LA (US) 70508

( * ) Notice: Subject to any disclaimer, the term of this patent is extended or adjusted under 35 U.S.C. 154(b) by 186 days.

(21) Appl. No.: 09/767,571

(22) Filed: Jan. 22, 2001

(65) Prior Publication Data

US 2002/0142275 A1 Oct. 3, 2002

(51) Int. Cl.[7] ..... G09B 19/00
(52) U.S. Cl. ..... 434/246
(58) Field of Search ..... 434/235, 236; 235/123

(56) References Cited

U.S. PATENT DOCUMENTS 3,806,911 A 4/1974 Pripusich
4,601,584 A * 7/1986 DeWolf et al. ..... 368/327
5,505,562 A 4/1996 Bosmani

FOREIGN PATENT DOCUMENTS

EP 0646903 A1 * 5/1995
PL P 304 461 8/1994

* cited by examiner

*Primary Examiner*—Joe H. Cheng
*Assistant Examiner*—Kathleen M Christman
(74) *Attorney, Agent, or Firm*—Robert N. Montgomery

(57) ABSTRACT

A hand held apparatus for prompting and or teaching the recitation of prayers associated with the Rosary including a highly decorative and compact electronic, battery-powered instrument that may be worn as decoration and held in the user's hand for easy operation, the apparatus having audio and prayer tracking capability utilizing a microprocessor for controlling a plurality of miniature lights clustered around a large centrally located sequencing button in conjunction with a voice message used to prompt the user by audibly reciting the first portion of a prayer, thereby eliciting a response by the user for the remaining portion of the prayer before continuing stepping through the sequential prayers of the Rosary. The apparatus is further distinguishable by a decorative cross serving as the power on and reset switch, the cross having lights at each point which are sequenced on initial activation to make the sign of the cross with lights. Speakers are provided having volume controls for use with group prompting and remote earplugs are provided for personal meditative use.

21 Claims, 3 Drawing Sheets

METHOD AND APPARATUS FOR TRACKING AND PROMPTING THE RECITATION OF THE ROSARY

BACKGROUND OF THE INVENTION

1. Field of the Invention

This invention relates generally to an electronic apparatus for assisting in the recitation of the Catholic Rosary and more particularly to the vocal prompting of a believer in the recitation of prayers.

2. General Background

The Catholic Rosary is a series of repetitious prayers recited in honor of the Blessed Virgin Mary. The prayers consist of a series of ten Hail Mary prayers divided by prayers such as the Lord's Prayer and Our Father. Meditation is further focused on the Mysteries of Redemption consisting of three series of five verses regarding Jesus and Mary's Joy, Sorrow, and Gloria described as being the Joyful, Glorious and Sorrowful mysteries.

It is therefore desirable for the believer to combine both the mental meditation and vocalization when saying the prayers.

Due to the complexity and number of prayers involved in saying the Rosary, various apparatuses have been devised for personal use in keeping track of the prayers recited. The most common is the Rosary beads whereby each bead on a string represents a prayer or a number of prayers recited. Such Rosary beads have become more elaborate over the centuries but serve essentially the same function today. More recently attempts have been made to combine electronic visual imaging in combination with a displayed reading of the Rosary prayers such as that disclosed by Stefano Bosmani in U.S. Pat. No. 5,505,622. The apparatus disclosed by Bosmani supposedly provides a means for displaying the Rosary prayers digitally in sequential order on command by pressing a button. In one embodiment a second button is provided for actuating a series of LED lights representing a single repetitive prayer, such as the Hail Mary prayer. LED lights are further disclosed for indicating which of the mystery series of prayers is being displayed at any given time. A buzzer is also provided for emphasizing the most important parts of the prayers. It is also anticipated that a vocal synthesizer may be provided for reciting the messages. However, the Bosmani disclosure is far from clear about precisely how these features are to be integrated and function.

Other electronic Rosary apparatus have been disclosed in U.S. Pat. Nos. 4,601,584 and 3,806,911 and Polish patent application number P304, 461. Each of the prior art electronic Rosaries discloses various means for displaying images, verbal prayers, and tracking the number of prayers of the Rosary recited. However, none of the prior electronic Rosary apparatus serves as a prompter by vocally prompting the recitation by reciting a prerecorded first portion of the prayer, thereby eliciting a response from the user to complete the second portion of each prayer required for the Rosary. Further, since meditation is essential in reciting the Rosary, having a large number of people reciting the Rosary simultaneously with buzzers sounding would be distracting to everyone. Being required to read a displayed full text of the prayers while viewing displayed images in precise order would be very time consuming and useless for those with visual or reading problems. Therefore, simply providing an electronic Rosary Prompter having prerecorded prompts though an earphone would be quite beneficial to even the fully initiated Rosary user. It would also be beneficial to have an apparatus that could output the prompt verbally in a non-synthesized manner and in a clear and recognizable voice over a speaker to lead a group in the Rosary Prayers. The user could also utilize such a system by using and earphone for silent prompting without the need to read displayed text or view images. Although speakers associated with Rosary apparatus have been anticipated in the prior art, no provisions have been provided for their incorporation into such devices, nor has the prior art anticipated a means for audibly prompting the user with a truncated portion of the Rosary prayers. Therefore, a more efficient and useful Rosary apparatus for use in prompting the user in reciting the rosary is taught herein.

SUMMARY OF THE INVENTION

The invention as taught herein provides an improved hand held apparatus for audibly prompting or teaching, as well as tracking, the recitation of prayers associated with the Rosary. The apparatus provides a highly decorative and compact electronic, battery-powered instrument that may be worn as decoration and held in the user's hand for easy operation. The apparatus having audio and prayer tracking capability utilizes a plurality of miniature lights clustered around a large centrally located sequencing button. The device is further distinguishable by a decorative cross serving as the power on and reset switch, the cross having lights at each point. A speakers is provided with volume control for use as a group prompt. A remote earplug is also provided for personal meditative use. Selector switches are provided for versatility in selecting types of prayers.

Means has been utilized to conserve power consumption to prolong battery life and thereby reduce operating expense. It is an object of the disclosed apparatus and method of operation to provide an electronic Rosary apparatus that is compact, attractive, and easy to use with maximum coverage of the entire range of Rosary prayers. By simply prompting the user with an abbreviated portion of the prayer, thereby eliciting a response from the user to complete the prayer before continuing stepping through the sequential prayers of the Rosary, the user does not lose track of the recited prayers. If distracted, the user may simply let the device power down at any time, then return to the point of interruption and resume the prayers. However, the user may reset the device at any time and restart the sequence. It is important to note the use of digitally recorded messages preferable by well-known priest and the like. Such messages are played back on a high quality internal speaker in a clear, recognizable manner or transmitted to a remote speaker, such as an earphone.

It is also important to note the disclosed invention as taught herein is a simplified audio prompter with visual tracking and not simply a prayer counter or apparatus only capable of displaying and or audibly reciting the rosary prayers on demand or as related to imaging.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
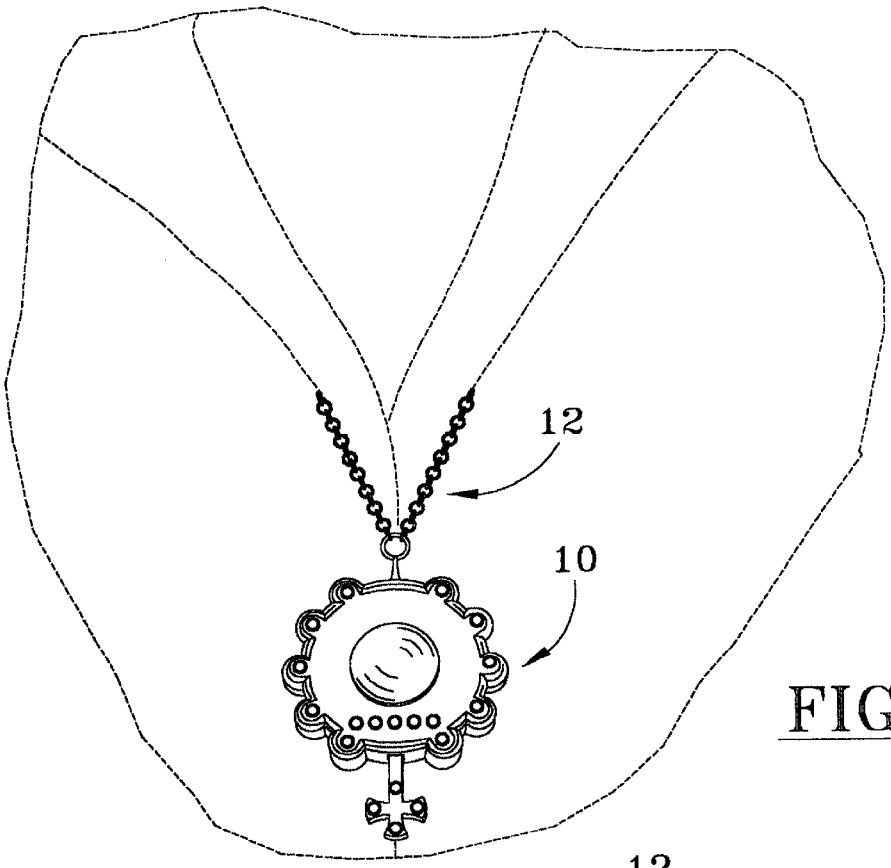
FIG. 1 is an isometric view illustration of the invention worn by a user as a pendant.
Figure 3:
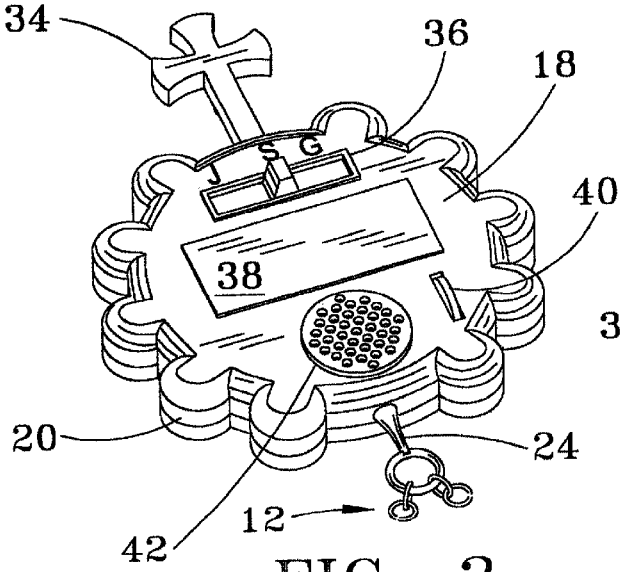
FIG. 3 is an enlarged front isometric view of the invention illustrated in FIG. 1.
Figure 4:
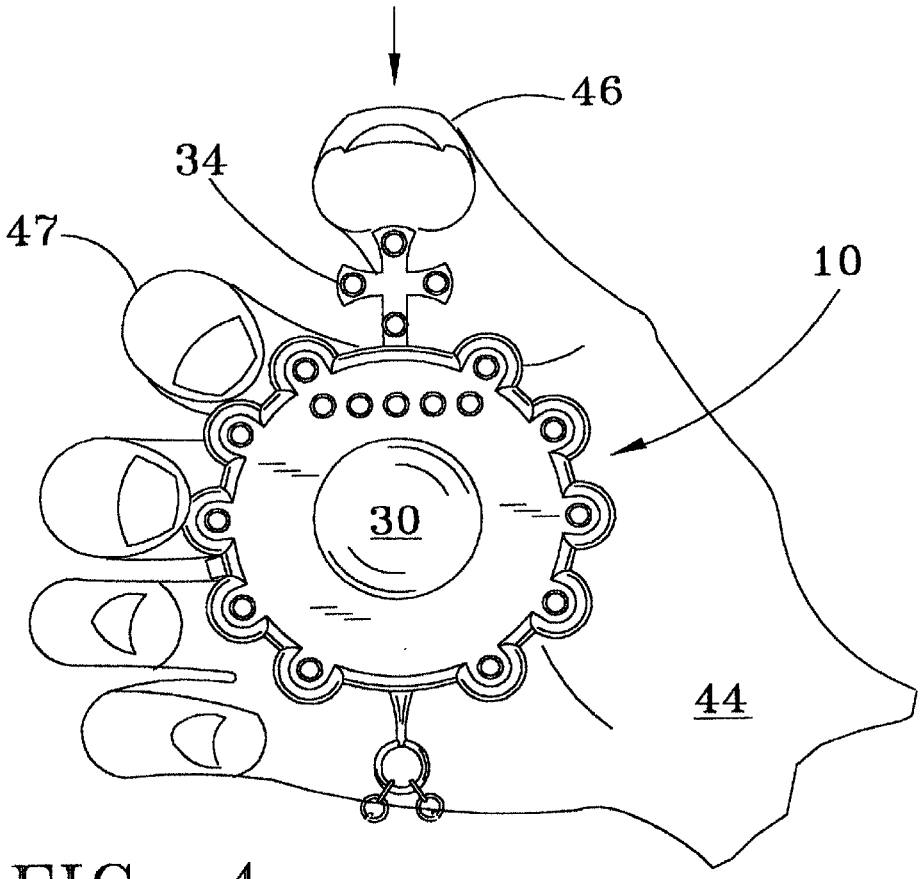
FIG. 4 is an isometric illustration of the invention shown in FIG. 1 held in a user's hand showing activation.

The Electronic Rosary prompter 10 as depicted in FIG. 1 is basically a hand held apparatus as depicted in FIG. 4. However, the apparatus may be suspended from a chain 12 and placed about the user's neck, thus worn as a decorative pendant.

Figure 2:
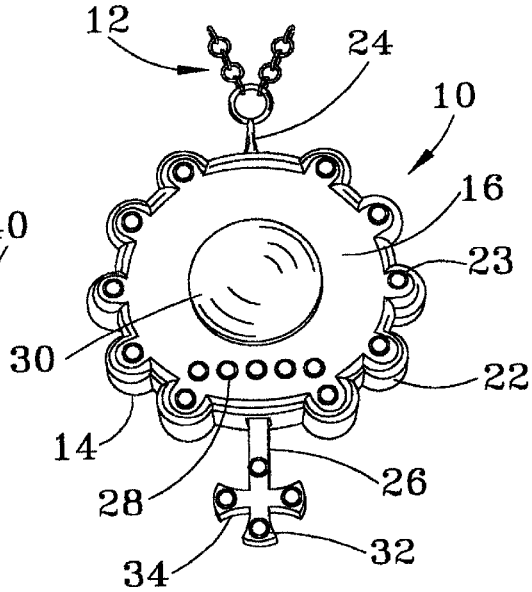
FIG. 2 is a rear isometric view of the invention seen in FIG. 1.
Figure 5:
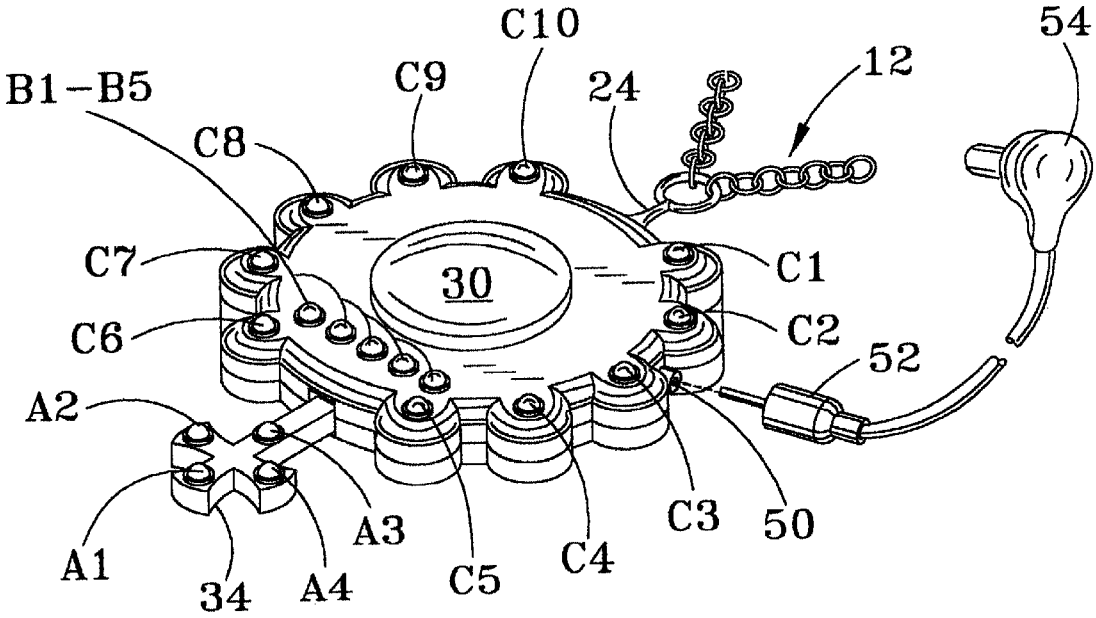
FIG. 5 is an enlarged front isometric view of the invention showing external earphone connection.

As seen in FIG. 2, the chin 12 may be attached to the apparatus in a fixed manner or made removable with the addition of a snap or hook arrangement if desired. The apparatus 10 comprising a case or housing 14 having circular contoured shape including a front case portion 16 and a rear case portion 18, the case portions having cooperative connecting edges which can be separated along the seam line 20. The case has ten lobes 22 divided equally each side of a centerline extending through the chin connection 24 and the cross actuation stem 26. Each lobe 22 of the front case portion 16 includes a red LED light source 23. Each red LED, labeled C1–10 in FIG. 5, represents one Hail Mary prayer. The front case portion 16 also includes a row of five blue or green LEDs 28 representing each of the five stories in each of the three mysteries. A switch having large conical or mushroom head operator button 30 is centered in the front case portion 16 for sequentially stepping through the Rosary. Each press of the momentary contact button 30 initiates an audible voice message of a portion of the prayer as a prompt, signaling a response request of the remaining portion of the prayer from the user prior to the next message. Four additional LEDs 32 in multiple colors, such as amber, red, green, and blue, are located at each end of the cross 34 attached to the switch actuator stem 26. These LEDs are indicative of the special prayers, such as the Apostles Creed, Our Father, Glory Be, and Hail Holy Queen. These LEDs 32 are illuminated whenever these special prayers are applicable in the sequence of the rosary, as well as upon initial activation of the apparatus, whereby the sign of the cross is made by sequencing through these LEDs 32. It should be noted that the front of the case portion 16 may be highly decorated with embossed engravings.

The rear case portion 18 includes a slide switch 36 for selectively choosing each of the three mysteries (Joyful, Sorrowful and Glorious), a battery compartment 38, a volume control wheel 40, and a speaker 42.

As seen in FIG. 4, the Rosary Prompter is a hand held apparatus that fits in the palm of the hand 44 whereby the apparatus is first activated by pressing and releasing the cross 24 with the thumb 46. A second press of the cross 34 and simultaneous pressing of the center momentary contact push button 30 resets the internal sequencer that keeps track of where the user stopped in the last interrupted prayer.

As shown in FIG. 5, the LED lights are identified herein for operational purposes with the ten red LEDs 23 labeled as C1–10, the five LEDs 28 as seen in FIG. 2 representing the five stories of each of the mysteries labeled as B1–5, and the LEDs 32 located on the cross 34 representing the special prayers of the cross labeled as A1–4.

A connector socket 50 is provided for connection of a connector jack plug 52 leading to an earphone. However, it is anticipated that a remote cordless transceiver may be used in place of the earphone jack plug arrangement.

Figure 6:
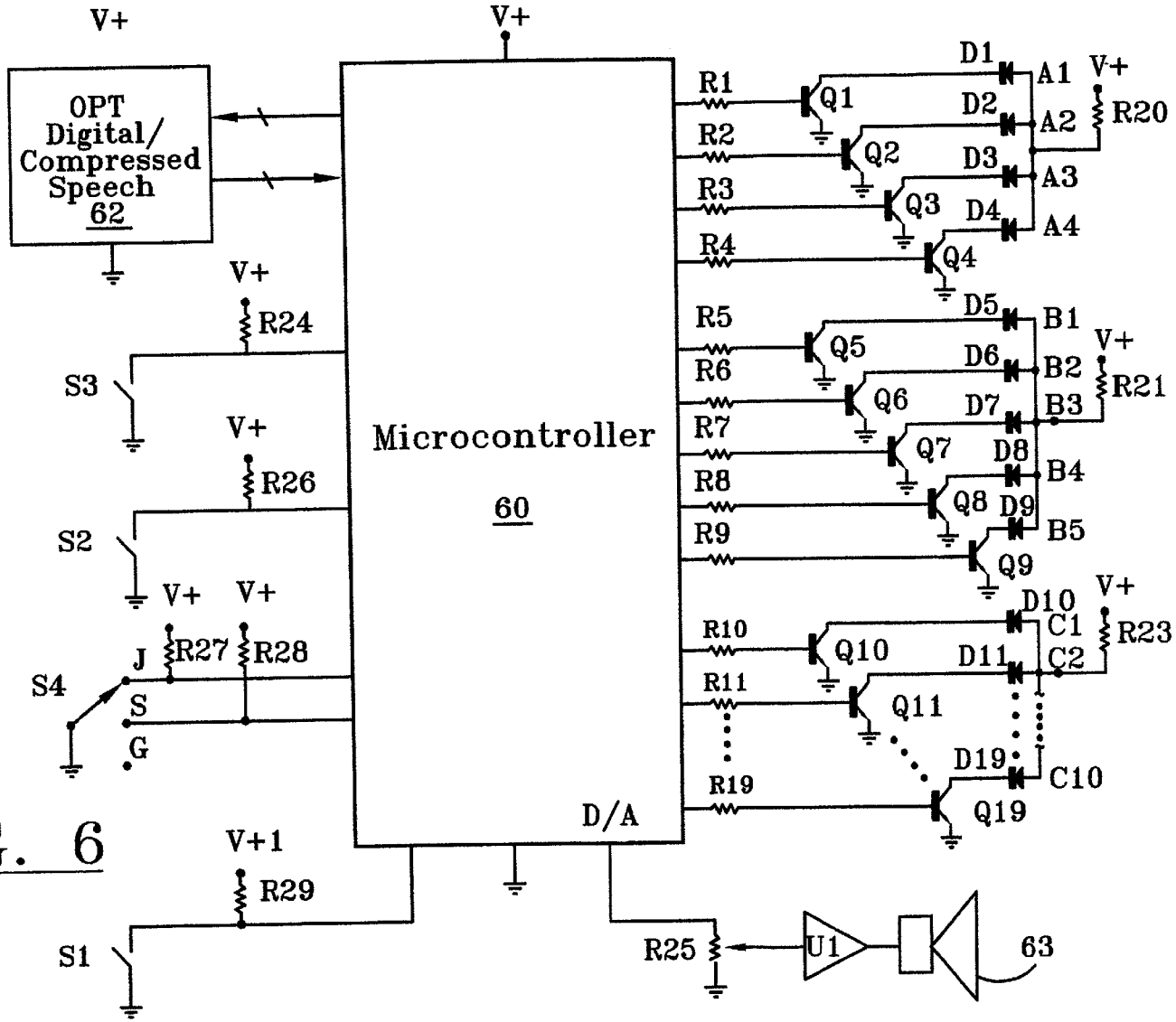
FIG. 6 is an electronic schematic diagram for the invention.

The internal electronic circuitry is illustrated in FIG. 6, wherein a micro-controller 60 controls the LEDs, switching, and speech messaging process. Power from an onboard, replaceable 3-volt DC power supply provides power to each of the V+ nodes in the diagram. A one time programmable memory chip 62 is provided and connected to the Microcontoller 60 to handle digitized compressed speech (OTP) messages, thereby allowing clear recognizable speech messages by well-known orators to be stored for replay on demand. It also is possible to provide a means for storing audio directly without any digitization. It is further anticipated that the OTP memory could be provided onboard a custom made Micro-controller. Switching is provided for turning the device on and off at Switch S1. The system remains in a sleep mode until the Switch S1 is actuated. In the wake-up mode the controller takes up where the sequential operation left off or was interrupted before being turned off or allowed to go to sleep to conserve power. To reset the system to start afresh, the Switch S2 and the momentary switch S3 are closed simultaneously. Selection of either an abbreviated message prompt provided when switch S2 is in the open position or the full message when Switch S2 is closed. Step sequencing of the LEDs and messages is controlled by the momentary push button S3. Selection of the mysteries is achieved with the three-position slide switch S4, the "G" or Glorious position being considered the default position with the "J" or Joyful and "S" or Sorrowful positions being alternatively selectable. However, any of the three positions may be connected as the default position. The micro-controller outputs signals to the light emitting diode LEDs D1–D19 with D1–D4 labeled as A1–A4, D5–D9 labeled as B1–B5 and D10–D19 labeled as C1–C10 via transistors Q1–Q19 and current limiting resistors R1–R19. Diodes D12–D18, transistors Q12–Q18, and current limiting resistors R12–R1S are indicated by dots but not shown to prevent over reduction of the schematic diagram. Current limiting resistors R24, R26–R29 are also provided at each V+ node in cases where such limiting resistors are not provided internal to the Micro-controller. A digital to analog (D/A) output is also provided with variable resistance R25 for volume control of the Audio Amplifier U1 and speaker 63.

TABLE 1

6.0 Theory of Operation

| User Action | State | Response | A1 | A2 | A3 | A4 | B1 | B2 | B3 | B4 | B5 | C1 | C2 | C3 | C4 | C5 | C6 | C7 | C8 | C9 | C10 |
|---|---|---|---|---|---|---|---|---|---|---|---|---|---|---|---|---|---|---|---|---|---|
| On Power up | −4 | ¼ sec Flash on | x | | | | | | | | | | | | | | | | | | |
| | −3 | ¼ sec Flash on | | | x | | | | | | | | | | | | | | | | |

TABLE 1-continued 6.0 Theory of Operation

| User Action | State | Response | A1 | A2 | A3 | A4 | B1 | B2 | B3 | B4 | B5 | C1 | C2 | C3 | C4 | C5 | C6 | C7 | C8 | C9 | C10 |
|---|---|---|---|---|---|---|---|---|---|---|---|---|---|---|---|---|---|---|---|---|---|
| | −2 | ¼ sec Flash on | | | | x | | | | | | | | | | | | | | | |
| | −1 | ¼ sec Flash on | | x | | | | | | | | | | | | | | | | | |
| Press #1 | 1 | Apostles' Creed | x | | | | | | | | | | | | | | | | | | |
| Press #2 | 2 | Our Father | x | x | | | | | | | | | | | | | | | | | |
| Press #3 | 3 | Hail Mary | x | x | | | | | | | | x | | | | | | | | | |
| Press #4 | 4 | Hail Mary | x | x | | | | | | | | | x | | | | | | | | |
| Press #5 | 5 | Hail Mary | x | x | | | | | | | | | | x | | | | | | | |
| Press #6 | 6 | 1st Mystery | x | | | | x | | | | | | | | | | | | | | |
| Press #7 | 7 | Our Father | x | x | | | x | | | | | | | | | | | | | | |
| Press #8 | 8 | Hail Mary | x | x | | | x | | | | | x | | | | | | | | | |
| Press #9 | 9 | Hail Mary | x | x | | | x | | | | | | x | | | | | | | | |
| Press #10 | 10 | Hail Mary | x | x | | | x | | | | | | | x | | | | | | | |
| Press #11 | 11 | Hail Mary | x | x | | | x | | | | | | | | x | | | | | | |
| Press #12 | 12 | Hail Mary | x | x | | | x | | | | | | | | | x | | | | | |
| Press #13 | 13 | Hail Mary | x | x | | | x | | | | | | | | | | x | | | | |
| Press #14 | 14 | Hail Mary | x | x | | | x | | | | | | | | | | | x | | | |
| Press #15 | 15 | Hail Mary | x | x | | | x | | | | | | | | | | | | x | | |
| Press #16 | 16 | Hail Mary | x | x | | | x | | | | | | | | | | | | | x | |
| Press #17 | 17 | Hail Mary | x | x | | | x | | | | | | | | | | | | | | x |
| Press #18 | 18 | Glory Be | x | x | | x | x | | | | | | | | | | | | | | |
| Press #19 | 19 | 2nd Mystery | x | | | | x | x | | | | | | | | | | | | | |
| Press #20 | 20 | Our Father | x | x | | | x | x | | | | | | | | | | | | | |
| Press #21 | 21 | Hail Mary | x | x | | | x | x | | | | x | | | | | | | | | |
| Press #22 | 22 | Hail Mary | x | x | | | x | x | | | | | x | | | | | | | | |
| Press #23 | 23 | Hail Mary | x | x | | | x | x | | | | | | x | | | | | | | |
| Press #24 | 24 | Hail Mary | x | x | | | x | x | | | | | | | x | | | | | | |
| Press #25 | 25 | Hail Mary | x | x | | | x | x | | | | | | | | x | | | | | |
| Press #26 | 26 | Hail Mary | x | x | | | x | x | | | | | | | | | x | | | | |
| Press #27 | 27 | Hail Mary | x | x | | | x | x | | | | | | | | | | x | | | |
| Press #28 | 28 | Hail Mary | x | x | | | x | x | | | | | | | | | | | x | | |
| Press #29 | 29 | Hail Mary | x | x | | | x | x | | | | | | | | | | | | x | |
| Press #30 | 30 | Hail Mary | x | x | | | x | x | | | | | | | | | | | | | x |
| Press #31 | 31 | Glory Be | x | x | | x | x | x | | | | | | | | | | | | | |
| Press #32 | 32 | 3rd Mysrery | x | | | | x | x | x | | | | | | | | | | | | |
| Press #33 | 33 | Our Father | x | x | | | x | x | x | | | | | | | | | | | | |
| Press #34 | 34 | Hail Mary | x | x | | | x | x | x | | | x | | | | | | | | | |
| Press #35 | 35 | Hail Mary | x | x | | | x | x | x | | | | x | | | | | | | | |
| Press #36 | 36 | Hail Mary | x | x | | | x | x | x | | | | | x | | | | | | | |
| Press #37 | 37 | Hail Mary | x | x | | | x | x | x | | | | | | x | | | | | | |
| Press #38 | 38 | Hail Mary | x | x | | | x | x | x | | | | | | | x | | | | | |
| Press #39 | 39 | Hail Mary | x | x | | | x | x | x | | | | | | | | x | | | | |
| Press #40 | 40 | Hail Mary | x | x | | | x | x | x | | | | | | | | | x | | | |
| Press #41 | 41 | Hail Mary | x | x | | | x | x | x | | | | | | | | | | x | | |
| Press #42 | 42 | Hail Mary | x | x | | | x | x | x | | | | | | | | | | | x | |
| Press #43 | 43 | Hail Mary | x | x | | | x | x | x | | | | | | | | | | | | x |
| Press #44 | 44 | Glory Be | x | x | | x | x | x | x | | | | | | | | | | | | |
| Press #45 | 45 | 4th Mystery | x | | | | x | x | x | x | | | | | | | | | | | |
| Press #46 | 46 | Our Father | x | x | | | x | x | x | x | | | | | | | | | | | |
| Press #47 | 47 | Hail Mary | x | x | | | x | x | x | x | | x | | | | | | | | | |
| Press #48 | 48 | Hail Mary | x | x | | | x | x | x | x | | | x | | | | | | | | |
| Press #49 | 49 | Hail Mary | x | x | | | x | x | x | x | | | | x | | | | | | | |
| Press #50 | 50 | Hail Mary | x | x | | | x | x | x | x | | | | | x | | | | | | |
| Press #51 | 51 | Hail Mary | x | x | | | x | x | x | x | | | | | | x | | | | | |
| Press #52 | 52 | Hail Mary | x | x | | | x | x | x | x | | | | | | | x | | | | |
| Press #53 | 53 | Hail Mary | x | x | | | x | x | x | x | | | | | | | | x | | | |
| Press #54 | 54 | Hail Mary | x | x | | | x | x | x | x | | | | | | | | | x | | |
| Press #55 | 55 | Hail Mary | x | x | | | x | x | x | x | | | | | | | | | | x | |
| Press #56 | 56 | Hail Mary | x | x | | | x | x | x | x | | | | | | | | | | | x |
| Press #57 | 57 | Glory Be | x | x | | x | x | x | x | x | | | | | | | | | | | |
| Press #58 | 58 | 5th Mystery | x | | | | x | x | x | x | x | | | | | | | | | | |
| Press #59 | 59 | Our Father | x | x | | | x | x | x | x | x | | | | | | | | | | |
| Press #60 | 60 | Hail Mary | x | x | | | x | x | x | x | x | x | | | | | | | | | |
| Press #61 | 61 | Hail Mary | x | x | | | x | x | x | x | x | | x | | | | | | | | |
| Press #62 | 62 | Hail Mary | x | x | | | x | x | x | x | x | | | x | | | | | | | |
| Press #63 | 63 | Hail Mary | x | x | | | x | x | x | x | x | | | | x | | | | | | |
| Press #64 | 64 | Hail Mary | x | x | | | x | x | x | x | x | | | | | x | | | | | |
| Press #65 | 65 | Hail Mary | x | x | | | x | x | x | x | x | | | | | | x | | | | |
| Press #66 | 66 | Hail Mary | x | x | | | x | x | x | x | x | | | | | | | x | | | |
| Press #67 | 67 | Hail Mary | x | x | | | x | x | x | x | x | | | | | | | | x | | |
| Press #68 | 68 | Hail Mary | x | x | | | x | x | x | x | x | | | | | | | | | x | |
| Press #69 | 69 | Hail Mary | x | x | | | x | x | x | x | x | | | | | | | | | | x |
| Press #70 | 70 | Glory Re | x | x | | x | x | x | x | x | x | | | | | | | | | | |
| Press #71 | 71 | Hail Holy Queen | x | x | x | x | x | x | x | x | x | | | | | | | | | | |
| Press #72 | −4 | Restart | | | | | | | | | | | | | | | | | | | |

On power uo, the 4 LED's A1 through A4, continue to blink (each for a ¼ of a second) in a sequence forming the sign of the cross. This mode corresponds to states −4 through −1 in the Table above.

Upon the first button press, the device gets out of the Cross cycle and goes into state 1. In this state, LED Al is lit and the Apostles' Creed is played. Upon the second button press, the device goes into state 2 during which A2 in addition to A1 become lit and Our Father is played. This process continues until state 71 according to the Table above. Upon the $72^{nd}$ button press the device goes back to the starting/initial mode: cycling through the sign of the Cross.

In order to reduce the complexity of the electronic circuit in this device, power to the LEDs D1–D19 is designed to be turned on in a time-multiplexed fashion. In this mode of operation, the LEDs are never kept on continuously. If a group of LEDs is supposed to be lit, each LED is turned on (current flows through it) only for 2 ms in a consecutive order, and this cycle repeats itself. If the group consists of five LEDs, each will be on for 2 ms every 10 ms; that is, 20% of the time at a rate of 100 times per second. In order to get a nominal brightness from these multiplexed LEDs, the current flowing through it during the 2 ms on period is increased five fold the nominal current required by the LEDs. Typically, the small size LEDs are driven by 1 mA in a steady state; thus, 5 mA of current will be necessary during time-multiplexing in order to achieve the steady-state, factory-specified brightness. Obviously, the power dissipated in a single LED in either case is the same.

Because the Talking Rosary Prompter has more than five LEDs (total of 19 LEDs), the LEDs time-multiplexing are designed slightly differently than the previously explained scheme. The LEDs are grouped in five pairs as indicated in the following table:

TABLE 2

| LEDs Time Multiplexing | | |
|---|---|---|
| Cycle #1 | A1 | B1 |
| Cycle #2 | A2 | B2 |
| Cycle #3 | A3 | B3 |
| Cycle #4 | A4 | B4 |
| Cycle #5 | Ci | B5 |

Where Ci represents one of C1 through C10. This arrangement is possible since only one of the LED's in group C is turned on at a time in any of the states as indicated in Table 1. At any given state, the LED's are turned on in five consecutive pairs. In order to understand this better, the following example will help. Upon the $69^{th}$ button press the device is in the following state:

During this state the LED's are turned on as follows:

| LEDs Time Multiplexing | | | | |
|---|---|---|---|---|
| Cycle #1 | A1 | On | B1 | On |
| Cycle #2 | A2 | On | B2 | On |
| Cycle #3 | A3 | | B3 | On |
| Cycle #4 | A4 | | B4 | On |
| Cycle #5 | C10 | On | B5 | On |

The above table is translated as: for 2 ms A1 and B1 are turned on, then A2 and B2 are on for the next 2 ms, during the $3^{rd}$ cycle only B3 is on, during the $4^{th}$ cycle only B3 is on, during the $5^{th}$ cycle C10 and B5 are on. Each cycle is 2 ms in duration. With the exception of the first 4 (−4 to −1) states, the 5 cycles are repeated continuously in each state. During each on of the 5 cycles there can be no more than 2 LEDs of the total of 19 LEDs turned on at the same time. However, it is possible that no LED is turned on during a cycle or only one LED, as in cycle 3 and 4 above. Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. An electronic Rosary prompter comprising:

a circular encasement sized to be hand held, said encasement comprising contoured front and rear case members, each having a connecting edge forming a continuous seam for connecting said front and rear case members on to the other, thereby defining a cavity there between;

a microprocessor housed within said cavity;

a one time programmable memory chip containing digital recorded speech housed within said cavity;

a momentary contact push button having a mushroom operator button centrally located in said front case member, a row of light emitting diodes (LEDs) located adjacent said mushroom operator button;

a plurality of LEDs surrounding said mushroom operator button and said row of LEDs;

a switch stem extending from said cavity for sequentially activating said plurality of LEDs, proximate said connecting edge, wherein said switch stem is in the shape of a cross having an LED at each end;

a means for communicating said recorded speech audibly to a remote receiver, so as to Prompt a user to recite a praver; and an audio speaker, a volume control, a selector switch, and a battery power supply, each connected to and controlled by said microprocessor, wherein said row of LEDs and said plurality of LEDs are controlled by said

| User Action | State | Response | A1 | A2 | A3 | A4 | B1 | B2 | B3 | B4 | B5 | C1 | C2 | C3 | C4 | C5 | C6 | C7 | C8 | C9 | C10 |
|---|---|---|---|---|---|---|---|---|---|---|---|---|---|---|---|---|---|---|---|---|---|
| Press #69 | 69 | Hail Mary | x | x | | | x | X | x | x | x | | | | | | | | | | x |

microprocessor and represent a prayer to be recited in the recitation of the rosary.

2. The electronic Rosary prompter according to claim 1 wherein said plurality of LEDs surrounding said mushroom operator button is indicative of a specific number of repetitive prayers recited, representing a decade.

3. The electronic Rosary prompter according to claim 2 wherein said row of LEDs located adjacent said mushroom operator button represent each of the holy mysteries.

4. The electronic Rosary prompter according to claim 3 wherein the LED located at each end of said cross is indicative of the Apostles Creed, Our Father, Glory Be, and the Hail Holy Queen prayers.

5. The electronic Rosary prompter according to claim 1 wherein said Rosary prompter has means for attaching a chain for suspending said prompter from around the neck of a user.

6. The electronic Rosary prompter according to claim 4 wherein the prayers are digitally prerecorded on the one time programmable memory chip and are audibly played, at least in part, on sequential command by pressing said push button.

7. The electronic Rosary prompter according to claim 6 wherein said Rosary prompter further comprises a selective means for audibly playing only a portion of each of said prayers, thereby prompting a user for the recitation of the remainder of the prayer.

8. The electronic Rosary prompter according to claim 6 wherein said Rosary prompter further comprises a means for selectively electing a specific group of said mysteries to be played.

9. The electronic Rosary prompter according to claim 6 wherein said Rosary prompter further comprises a means for returning to an interrupted sequence at point of int erruption.

10. The electronic Rosary prompter according to claim 9 wherein said Rosary prompter further comprises a sleep mode to conserve power.

11. The electronic Rosary prompter according to claim 10 wherein said Rosary prompter further comprises a remote receiver.

12. The electronic Rosary prompter according to claim 1 wherein said Rosary prompter further comprises a remote speaker.

13. An electronic rosary prompter comprising:

a) a circular encasement sized to be hand held having a front and a rear case member interconnected forming a cavity there between, each of said case members having a contoured outer surface and a connecting edge, said connecting edges when connected defining a seam;

b) a push button centrally located in said front case member operative from said outer surface;

c) a plurality of miniature lights at least partially surrounding said push button;

d) a switch stem operatively extending from said cavity proximate said seam, said switch stem configured in the shape of a cross;

e) a miniature light located at each end of said cross;

f) a plurality of miniature lights located in a row adjacent said push button;

g) a means for connecting audio transmission between said prompter and a remote earphone;

h) an audio speaker located within said cavity;

i) a volume control means connected to said speaker;

j) a microprocessor having digital recording and playback capability located within said cavity connected to said miniature lights, a plurality of switches, and said speaker, said microprocessor controlling sequencing of said lights and said digital recording; and l) a battery power supply connected to said microprocessor.

14. The electronic Rosary prompter according to claim 13 wherein said push button is a contoured mushroom shape.

15. The electronic Rosary prompter according to claim 13 wherein said miniature lights are LEDs.

16. The electronic Rosary prompter according to claim 15 wherein said LEDs are activated in time-multiplexed manner.

17. The electronic Rosary prompter according to claim 16 wherein no more than two of said LEDs are activated at any given time during the operation of said prompter.

18. A method for prompting the recitation of Rosary Prayers comprising the steps of:

a) providing a hand held apparatus having a plurality of LEDs, representing a plurality of prayers to be recited in the rosary connected to a battery powered microprocessor wherein said microprocessor has compressed digital speech recording and playback capability, a means for audio projection of recorded messages at least in part, and means for selecting specific groups of said recorded messages, said microprocessor controlling sequential illumination of said LEDs and digital speech playback in response to user manual manipulation of a momentary contact switch;

b) activating said apparatus from a sleep mode to active mode;

c) selecting portion of said recorded messages to be played;

d) selecting said specific group of messages to be played; and e) stepping sequentially though a series of said recorded messages and said LED illuminations by repetitious depression of said momentary contact switch.

19. The method according to claim 18 wherein said steps further include an initial step, upon activation, of sequentially stepping through a set of four LEDs located on a cross portion thereby making the sign of the cross.

20. The method according to claim 18 wherein said steps further include the step of controlling the volume of said messages to be played.

21. The method according to claim 18 wherein said steps further include the step of adapting a remote speaker to said apparatus.

* * * * *